US005819569A

United States Patent [19]

Herdman

[11] Patent Number: 5,819,569

[45] Date of Patent: Oct. 13, 1998

[54] LOCK WITH CHANGEABLE WARDING POSITIONS

[76] Inventor: Rodrick A. Herdman, 7845 Millcreek Cir., West Chester, Ohio 45069

[21] Appl. No.: 697,735

[22] Filed: Aug. 29, 1996

[51] Int. Cl.[6] ..... E05B 15/06

[52] U.S. Cl. ..... 70/420; 70/383; 70/427

[58] Field of Search ..... 70/491, 493, 419–421, 70/356, 358, 453, 454, 382–385, 423, 427

[56] References Cited

U.S. PATENT DOCUMENTS

| | | | |
|---|---|---|---|
| 3,258,944 | 7/1966 | Kerr | 70/382 X |
| 3,258,945 | 7/1966 | Kerr | 70/382 X |
| 3,693,384 | 9/1972 | Genakis | 70/356 X |
| 3,736,780 | 6/1973 | Singer | 70/453 |
| 3,868,838 | 3/1975 | Zimmerman et al. | 70/383 |
| 3,961,507 | 6/1976 | Falk | 70/363 |
| 4,063,433 | 12/1977 | Matsui | 70/358 |
| 4,104,898 | 8/1978 | Fois | 70/423 X |
| 4,446,709 | 5/1984 | Steinbach | 70/496 |
| 4,490,998 | 1/1985 | Wellekens | 70/419 |
| 4,616,492 | 10/1986 | Barfield | 70/383 X |
| 4,735,069 | 4/1988 | Steinbach | 70/420 X |
| 4,747,281 | 5/1988 | Monahan | 70/383 |
| 4,770,149 | 9/1988 | Krauer | 70/358 |
| 5,088,306 | 2/1992 | Field | 70/375 |
| 5,233,850 | 8/1993 | Schroeder | 70/337 |
| 5,325,690 | 7/1994 | Adler et al. | 70/383 |

FOREIGN PATENT DOCUMENTS

| | | | |
|---|---|---|---|
| 402826 | 9/1924 | Germany | 70/427 |

*Primary Examiner*—Suzanne Dino Barrett
*Attorney, Agent, or Firm*—Jim Blackwood, Esq.

[57] ABSTRACT

A lock with changeable warding positions wherein a rotationally indexable warding member selectively enables one of a multiple of keys for operation of the lock.

24 Claims, 4 Drawing Sheets

LOCK WITH CHANGEABLE WARDING POSITIONS

FIELD OF THE INVENTION

The present invention relates to improvements in the field of locks and more particularly to cylinder locks having a method of allowing the use of more than one passkey.

DESCRIPTION OF RELATED ART

Locks are one of the oldest devices known to man, excepting perhaps the war club, and tumbler locks have been known and used for a very long time. A modern variation of the tumbler lock is the cylinder lock in which an interface or shear line between a lock housing and a cylindrical plug allows rotational motion therebetween. The lock has holes or bores running radially through the body of the housing and the plug, each of which contains one or more pins which cross the interface preventing rotation between the plug and the body, and a key which may be inserted longitudinally into the bore to raise the pins so that they no longer block the interface and the plug is allowed to turn. These pins are generally arranged so that a tumbler pin contacts the key and is biased towards that key by a driver pin, which is generally biased towards the tumbler pin by a spring. When it is desirable to construct a cylinder lock which uses not only the normal key, called a passkey, but also can accept another key called the master key, an additional pin is placed between the tumbler pin and the driver pin, and this pin is called the master pin. Such an arrangement of pins or tumblers, is commonly referred to as a tumbler stack or pin stack.

Frequently it is desirable to change the key used in any particular lock, and in this case past practice required the disassembly of the lock, removal of the pins, and replacement with pins of different lengths so that the lock would require a key having different heights, called bitting, at each of the pin positions. In common practice, a cylinder lock might have five to seven pin bores and each bitting position on the key might have five to ten discrete heights, thereby resulting in perhaps as many as one hundred thousand or more possible key combinations. This number is of course reduced by practical considerations and for other reasons such as the need for master keying, and for practical purposes might only be a fraction of that number, but a need has existed for a simple method of changing the key that operates the lock. A number of methods to accomplish this have been invented, each incrementally improving the key changeable cylinder lock, however, each has suffered shortcomings such as for instance, high manufacturing costs, complexity, and the need for a locksmith to accomplish the change.

For instance, Monahan, U.S. Pat. No. 4,747,281 issued May 31,1988, discloses a standard common pin tumbler cylinder lock which has been modified to allow changing of the key combination by changing the tumbler stack in the various pin bores. This is accomplished by the use of a special key which includes a transfer tool which can be used to capture a master pin from one of the pin stacks and either remove it from the lock or transfer it to another pin stack, or to add or remove a master pin, thereby changing the key combination and requiring a different key to operate the lock. It is instructional to note that changing of the master pins in this way causes the lock to require a different passkey, while allowing the same master key to be used as before. While Monahan is much more user friendly than the prior art devices, whoever has to change the combination is faced which having to handle master pins which are quite small, difficult to grasp, and easy to lose, and this person must have some familiarity with the internal workings of the cylinder lock, in short a locksmith. Also a supply of assorted master pins must be kept on hand, and the locksmith must be certain he is removing and or replacing the master pins in the correct location and using the correct size of master pin, so that the lock will match the selected passkey.

In Schroeder, U.S. Pat. No. 5,233,850 issued Aug. 10, 1993, a method is disclosed for changing the length of the tumbler pins, thereby causing the lock to require a different key. Each tumbler pin is a three part structure, and the plug incorporates a serrated rack which engages teeth on the outside of each tumbler pin shell to rotate the shell relative to the tumbler pin core thereby changing the tumbler pin length. Considering that tumbler pin size in a conventional lock is on the order of one eight inch diameter, this construction necessitates a tumbler pin shell of thin walled construction, and forces acting upon the tumbler pin shell at the shear line can be expected to dramatically and adversely affect the operation and life of this type of a device. Additionally, the serrated rack operates upon all tumbler pin shells at the same time so that it is not possible to create more usable key combinations than the number of warding heights in any one pin position, i.e. five combinations. Movement of the rack is accomplished either by removing the lock cylinder from the door, thereby obtaining access to the back of the lock cylinder, or by the use of an auxiliary lock the rotation of which causes the rack to be moved by a linkage therebetween. This additional complexity unavoidably results in added expense both in manufacture and in the installation.

Another approach to key changes was taken in U.S. Pat. No. 3,736,780 issued Jun. 5th, 1973 to M. Leonard Singer of New Jersey. Typically a key will have slots milled down the length of the key blade, and the lock will have internal projections or warding which will restrict entry to any key not having the required slots. Mr. Leonard's contribution to the art was to provide a means of changing the warding of the cylinder of the lock, thereby changing the key which would operate the lock. This was accomplished by the use of a plate which was attached to the outside or front of the plug of the lock by using rivets or other means of attachment. The plate had an internal projection thereby adding another warding element to the lock, and requiring the use of a different key. This method is restricted to one key change, and requires drilling holes in the plug to allow attachment of the plate with the rivets. The change can only be reversed by prying off the plate, possibly damaging the lock in the process, and leaving two unsightly holes showing in the front of the lock.

Likewise in U.S. Pat. No. 5,088,306 issued Feb. 18, 1992 to Peter H. Field of Salem, Va. for a cylinder lock with changeable keyways, the inventor has devised a means of changing the warding of the lock so that different configurations will only allow the use of keys specific to any one of those particular configurations, however this requires the removal and replacement of a warding member which is positioned in a slot in the key plug and retained by the use of pins, screws, clip rings, or by other means not disclosed. It is unclear whether or not the changing of these warding members can be accomplished without removal of the lock cylinder from the door or other device, but no description of a means of changing the warding member without removal of the lock is given. Also an assortment of various warding members matched to the passkeys to be used with the lock would have to be stocked, and ostensibly the change would have to be accomplished by a locksmith.

In another type of lock, the axial pin tumbler lock, means of resetting the lock for the use of different passkeys have also been devised, such as in U.S. Pat. No. 3,961,507 issued Jun. 8, 1976 to Morris Falk, of Palm Springs, Calif. This type of lock uses a tubular key which has notches cut on the outside periphery which engage tumbler pins set axially within the lock body moving said tumbler pins to allow relative movement of the lock parts at a shear plane, or lock interface, perpendicular to and concentric with the longitudinal centerline of the lock. A reset key is used to accomplish the change in the key combination by moving the tumbler pins relative to the driver pins at a second shear plane or reset interface so that a first passkey or service key no longer operates the lock and a second or other alternate passkey or service key does.

U.S. Pat. No. 4,770,014 issued Sep. 13, 1988 to Oswald Knauer of Germany discloses the use of a rod type key to operate a cylinder lock. This lock has no provision for changing of the lock combination, however it does discloses a rod type key in some respects similar to that used in the present invention. This lock however is designed for high security applications, with a multitude of radially positioned tumbler stacks, perhaps as many as 25 in number, where the present invention is more conventional in construction. Knauer's invention was a method of rotating the rod type key as it reached its final seated position in the lock so that wear in the pin stacks was reduced.

Finally, U.S. Pat. No. 4,063,437 issued Dec. 20, 1977 to Matsui et al. also discloses a lock which uses a rod type key, however in this case the key is designed to operate more than one lock, by combining the use of a radial tumbler orientation with two distinct orientations of those tumblers relative to a "key pin".

SUMMARY AND OBJECTS OF THE INVENTION

It is therefore an object of the invention to provide a new and novel type of lock and key arrangement whereby a reset key may be used to convert the lock from the use of an existing passkey to a second passkey.

Also an object is to provide a lock in which the reset key used to convert the lock to the use of at least a second passkey cannot be used to open said lock.

Another object of the invention is to provide a lock, changeable for use with different passkeys which is simple in construction and use.

An additional object is to provide a lock, changeable for use with different passkeys in which said change can be accomplished by a person not trained in the art of locksmithing.

Another additional object is to provide a cylinder lock plug retroactively fittable to existing cylinder locks, thereby providing the aforementioned changeable feature.

Yet another object is to provide a lock which can be changed to accept different passkeys which is inexpensive to manufacture.

Yet still another object is to provide a lock which can be changed to accept different passkeys and which can be installed in the conventional manner.

Still another object is to provide a lock which can be changed to accept different passkeys in which operation of the lock by wiggling of the key which is not the key with the correct combination is prevented.

Yet still another object of the invention is to provide a re-keyable lock conversion adapted to use with all major brands of cylinder locks.

Another object of the invention is to provide a re-keyable lock conversion in which the pick resistance of the host lock is thereby improved.

Another object is to provide a re-keyable lock in which damage or removal of the warding member will not allow the use of an old key to open said lock.

Also an object is to provide said re-keyable lock in which damage or removal of the warding member and a subsequent attempt to open said lock will result in entrapment of the key used in said attempt, rendering said lock inoperable.

Another object of the invention is to provide a re-keyable lock in which an old passkey cannot be inserted into the lock.

Another object of the invention is to provide a re-keyable lock in which anti pick measures can be employed.

Another object of the invention is to provide a re-keyable lock in which the number of usable keys can be increased exponentially.

Yet another object of the invention is to provide a re-keyable lock in which attempted forcible entry will render the lock inoperative.

Still another object of the invention is to provide a re-keyable lock in which use of a master key is provided.

Still another object of the invention is to provide a re-keyable lock in which the use of special anti tamper mechanisms is employed.

Another object of the invention is to provide a re-keyable lock in which more than one passkey can be enabled to operate the lock, and the lock can be changed to block the use of one of the more than one passkeys.

Yet still another object of the invention is to provide a re-keyable lock which can be constructed so that a store employee can lock the store upon leaving but cannot subsequently open the lock with the same key, said key being known as a "closing key".

Also another objective is to provide a key with warding which cannot readily be copied or duplicated by a locksmith or hardware store, thereby providing the customer with an effective means of key control.

Still another object is to provide a re-keyable lock conversion in which it is not necessary to modify the body of the host lock in any way.

These and other objects which will be apparent to practitioners of the art may be achieved by the embodiments of the invention as disclosed in the specification and drawings or variations thereof within the scope of the appended claims.

DESCRIPTION OF THE PREFERRED EMBODIMENT

Figure 1:
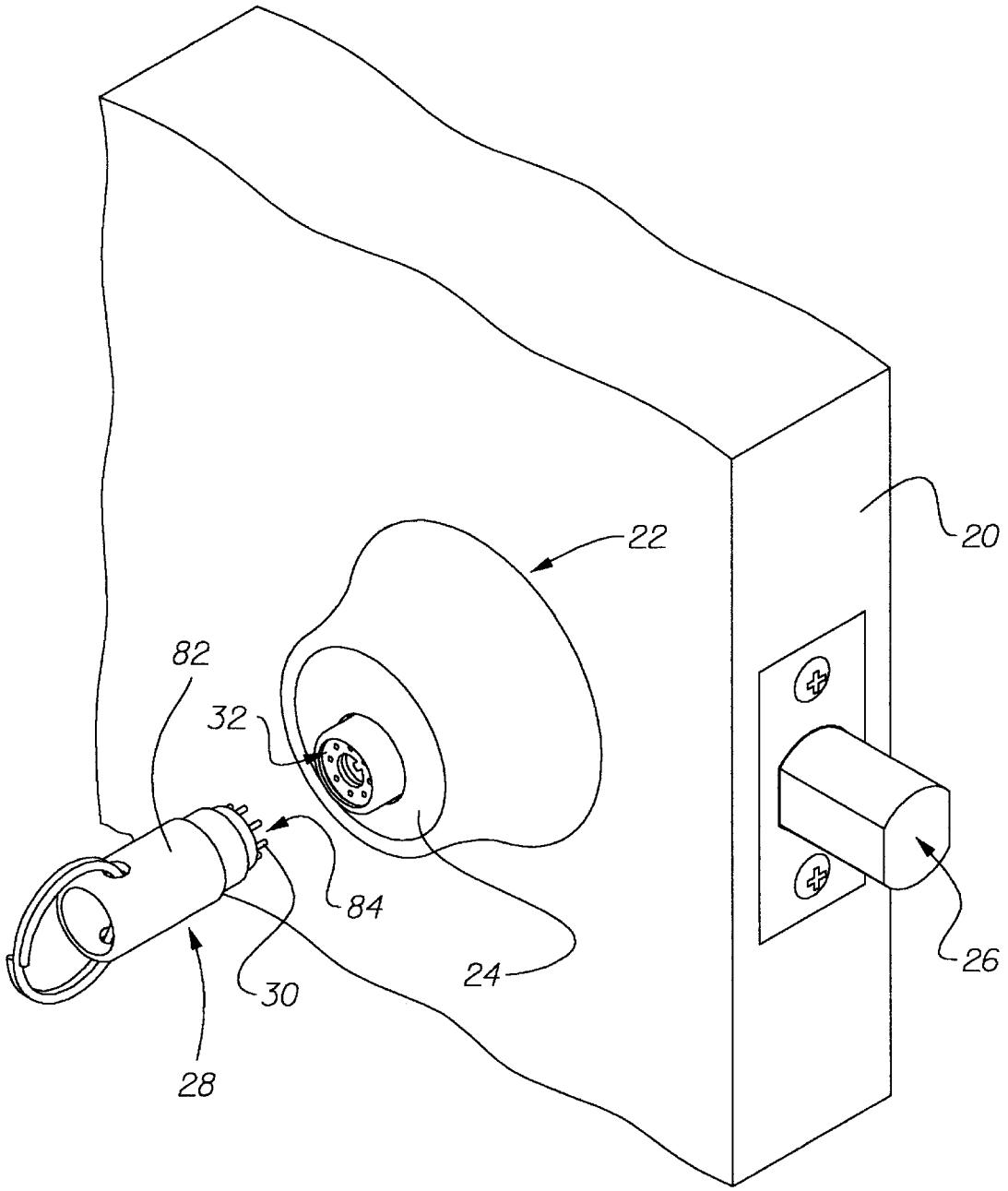
FIG. 1 is an isometric view of a section of a door having installed therein one embodiment of the invention, and showing a Reset Key adjacent thereto.
Figure 2:
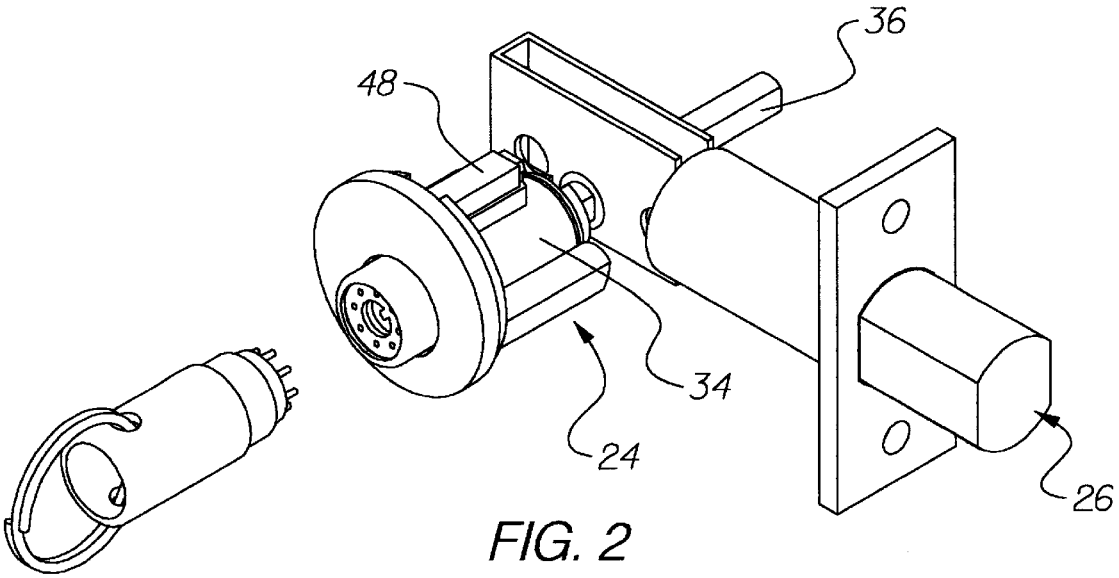
FIG. 2 is similar to the isometric view of the invention as shown in FIG. 1, but showing the lock and deadbolt mechanism thereof.

Referring now to the drawings, it can be seen in FIG. 1, that a preferred embodiment of the invention has a general appearance like that of a conventional cylinder lock, familiar to all practitioners of the art, but it is noted here that the inventor does not limit his invention to this specific application. In the preferred embodiment, a door 20, has mounted therein a lock assembly 22, in the conventional manner, comprised of a lock cylinder assembly 24, and a deadbolt 26. A reset key 28 is shown adjacent thereto, having reset key pins 30 projecting therefrom. These reset key pins 30, fit into a key reset structure 32 which will be described in detail later herein. In FIG. 2, the deadbolt 26 as shown, is operated by the cylinder assembly 24, in the conventional manner. A lock cylinder 34 is also conventional in construction and appearance, and in this embodiment may be a "Kwikset" lock cylinder as used in any commercially available entry deadbolt lock assembly manufactured by Kwikset. Indeed, any lock cylinder and lock assembly manufactured and sold by any major manufacturer may be used for this purpose, the primary distinguishing feature of those for the purposes of this disclosure being the manner of attachment of a tailpiece 36 to the cylinder assembly 24. The tailpiece 36 operates the deadbolt 26 in the conventional manner, and in turn is operated by a cylinder plug 38 seen in FIG. 3. A retainer mechanism, not shown, attaches the tailpiece 36 to the cylinder plug 38, and allows the cylinder plug 38 to control the rotation of the tailpiece 36 in a precise and predetermined manner, familiar to all locksmiths. Again, in FIG. 3, the lock cylinder 34 is shown as having cylinder pin chambers 40 disposed radially adjacent and perpendicularly intersecting a cylinder bore 42. In this embodiment, as in most commercial embodiments of the product, the cylinder pin chambers 40 are arranged linearwise in respect to a longitudinal centerline, not shown, of the cylinder. However, it is not necessary for the pin chambers 40 to be arranged either linearly or perpendicularly for the invention to function as intended, that is merely the predominant commercial arrangement. Likewise, each cylinder pin chamber 40 has associated therewith a driver pin 44 and a tumbler spring 46. These driver pins 44 and tumbler springs 46 are retained by a tumbler keeper or cap 48 seen in FIG. 2, thereby biasing the driver pins 44 inwardly towards the cylinder bore 42. The cylinder plug 38 differs from the conventional construction in a number of important areas, however it is constructed to fit, operate with, and be retained in the cylinder bore 42 of the lock cylinder 34 in a manner identical to any existing manufacturer's construction, as well as special constructions or future constructions. By this it can be seen that the cylinder plug 38, containing the operative elements of the invention, is retrofittable to existing locks, as well as new constructions.

Figure 3:
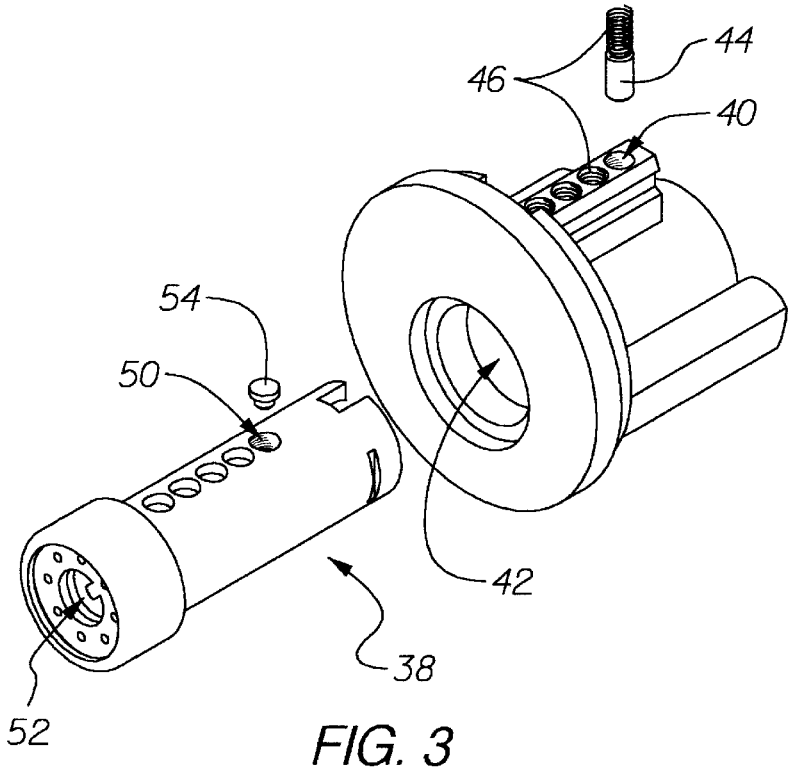
FIG. 3 is an enlarged exploded isometric view of the inner workings of the lock mechanism of FIG. 2, showing the Lock Cylinder, with an example of typical parts exploded out for clarity.
Figure 5:
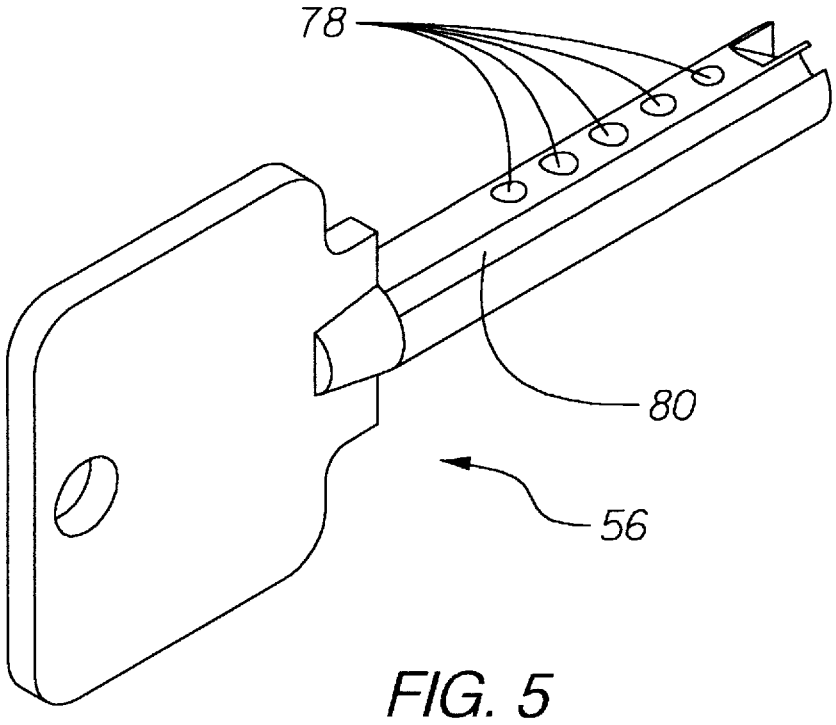
FIG. 5 is an enlarged isometric view of a passkey used with the lock shown in FIG. 1.

The cylinder plug 38 in FIG. 3 is shown as having plug pin chambers 50 disposed radially adjacent and perpendicularly intersecting a keyway 52. In this embodiment the plug pin chambers 50 are arranged linearwise in respect to a centerline, not shown, of the keyway 52, however, it is not necessary for the plug pin chambers 50 to be arranged either linearly or perpendicularly to the centerline for the invention to function as intended, as long as each plug pin chamber 50 is operationally oriented with respect to the cylinder pin chamber 40 with which it is associated, to be functional therewith. Indeed, it is even within the scope of the invention to provide an arrangement wherein the plug and cylinder pin chambers 50, 40 are offset from their associated centerlines, or even have no orderly orientation therewith, but of course this assumes an arrangement of pin chambers not common in currently marketed products and would therefore require a complete cylinder and plug assembly as opposed to only a retrofittable plug 38. Each plug pin chamber has associated therewith a tumbler pin 54 positioned within the bore of the plug pin chamber so as to project into the keyway 52. As is apparent from the drawings, each tumbler pin 54 has a step in the diameter thereof or is otherwise constructed to prevent the tumbler pin 54 from falling through the plug pin chamber 50 and into the keyway 52. The plug pin chamber 50 also is step drilled or otherwise constructed in a matching fashion to cooperate with the tumbler pin 54 for the aforementioned purpose. Each tumbler pin 54 may be of a different length, thereby setting the key combination required to open the lock. Each tumbler pin 54 is biased inwardly towards the keyway 52 by the tumbler spring 46 acting on the driver pin 44. The interface between the cylinder bore 42 and the corresponding surface of the cylinder plug 38 allows rotational movement therebetween, creating a shear plane relative to the pin chambers 40, 50. Insertion of a passkey 56 shown in FIG. 5, with the correct key combination raises the tumbler pin 54 so that the interface between the tumbler pin 54 and the driver pin 44 aligns within the aforementioned shear plane. This process is repeated for each pin chamber position, eliminating any obstruction to rotational movement of the cylinder plug 38 relative to the lock cylinder 34. Removal of the passkey 56 allows the tumbler spring 46 to urge the driver pin 44 and the tumbler pin 54 inwardly towards the keyway 52, causing the tumbler pin 54 to project into the keyway 52, and also causing the driver pin 44 to intersect the shear plane between the cylinder plug 38 and the lock cylinder 34. Insertion of a passkey 56 having the wrong combination will either result in the tumbler pin 54 not being raised against the urging of tumbler spring 46 far enough for the interface between the tumbler pin 54 and the driver pin 44 to intersect the shear plane, or will result in the tumbler pin 54 being raised sufficiently that the tumbler pin itself intersects the shear plane. In these two cases either the driver pin 44 or the tumbler pin 54 will block the shear plane, thereby preventing the cylinder plug 38 from turning relative to the lock cylinder 34. Only one of the aforementioned pins need intersect said shear plane to prevent rotation of the cylinder plug 38.

Figure 4:
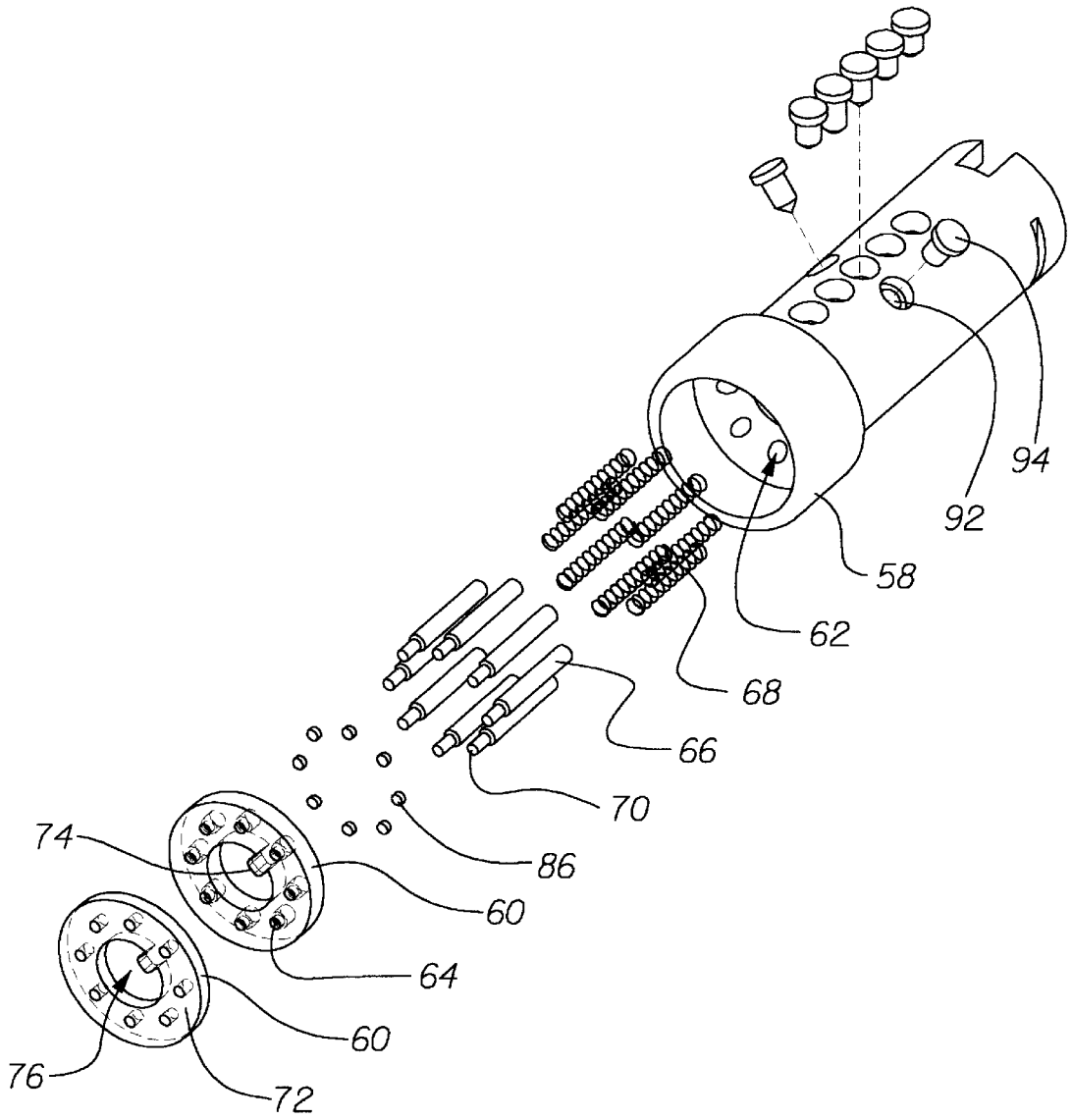
FIG. 4 is a further enlarged exploded view of the Plug of the Lock Cylinder shown in FIG. 3, showing details of the invention not otherwise visible.

In FIG. 4, the cylinder plug is exploded to show the details of its construction, particularly the key reset structure 32 previously mentioned. A nosepiece 58 forms the forewardmost part of the cylinder plug 38 and contains a recess therein to retain and house a warding member 60. One or more warding members 60 may be used depending on the desired number of changes of passkeys. For a small number of passkeys, such as eight or less for instance, one warding member may be used which has at least eight or less positions as will be described. For a larger number of passkeys more than one warding member may be used, in which case an exponential increase in the possible number of passkeys would occur. Other configurations of one or more warding members are forseeable. For instance, in a padlock using a magnetic key, a projection or indentation controlling the positioning of the key can serve the function of a warding member, and such a warding member can be made indexable.

The cylinder plug 38 has therein a number of reset pin bores 62 equally spaced around the centerline of the cylinder plug 38 and parallel therewith. These reset pin bores 62 may correspond to a like number of reset pin recesses 64 drilled in the one or more warding members 60, or they may be less as later herein described. Each reset pin bore 62 may house a reset pin 66 and a reset pin spring 68 which biases the reset pin 66 towards the warding member 60 and into the reset pin recess thereof. Each reset pin 62 is prevented from projecting through the outermost warding member 60 by a chamfer, counterbore, or other known construction in the reset pin recess 64, or the reset pin itself Other constructions providing equivalent results may also be employed, as numerous ways are known and used to achieve this result. As assembled, the reset pin 66 projects through the forwardmost warding member 60 just far enough for the forwardmost end 70 of the reset pin 66 to be flush with the forward surface 72 of the warding member 60 as seen in FIGS. 1, 2, and 3. Although not a requirement of the invention, this provides an improved appearance and other benefits. A warding bit 74 is shown in FIG. 4 projecting into a central bore 76 of the warding member 60. Although one warding bit 74 is shown, one or more warding bits may be employed around the periphery of the central bore projecting thereinto for the purposes of forming an opening requiring a unique key to mate therein. The warding bit is shown as having a simple semicircular cross section, however any complex shape that might be desired can be employed, provided the matching passkey 56 shown in FIG. 5 has adequate rigidity, and a suitable area for each tumbler pin 54 to register with. The warding member 60 may be constructed of a hardened material, also the warding bit 74 may be formed of a hardened material.

Figure 6:
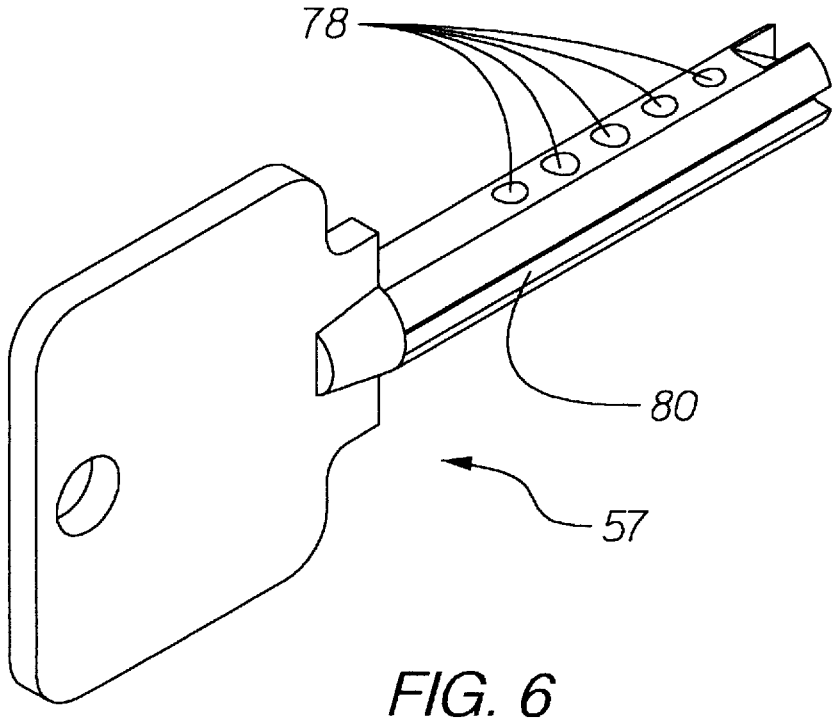
FIG. 6 is an enlarged isometric view of a passkey as shown in FIG. 5 showing an alternate position for the warding cut.

The interrelated function of the reset key 28 and the key resetting structure 32 is as follows. When it becomes desirable to change from one passkey 56 to another, the reset key 28 is inserted into the locking assembly 22 in such a way that the reset key pins 30 project into the forwardmost openings of the reset pin recesses 64 in the warding member 60, and depress the reset pins 66 against the reset pin springs 68. The reset key pins 30 are of a proper length to project sufficiently far through the warding member 60 so that the interface between the forward most end 70 of the reset pins 66 and the end of the reset key pins 30 is in line with the rear face of the warding member 60 thereby allowing the warding member 60 to be rotated by the reset key 28 to a new position, at which point the reset key 28 is removed and the reset pins 66 are allowed to project once more into the reset pin recesses 64, thereby blocking further rotation of the warding member 60. At this point, the previously used passkey 56 will no longer operate the lock because its bitting positions 78 no longer line up with the tumbler pins 54. However, a new passkey 57 shown in FIG. 6 with an identical combination, but with the warding cut 80 offset from the position occupied by the warding cut 80 of the first passkey 56, by an angle equal to that between the reset pin recesses 64, and in the same direction thereas, will fit into and operate the lock. If the nose of the first passkey 56 has the configuration shown in the drawings, it will no longer be possible to insert the first passkey 56 into the lock, since the ramp surface of the passkey is no longer lined up with the tumbler pins, and therefore cannot raise them to allow entry of the passkey. A passkey with a bullet shaped nose would enter the lock but not operate it.

Should it be desirable to provide for a greater number of passkeys, more than one warding members may be provided. In this case, operation is similar to that just described, except that more than one reset key 28 may be used, each of which may be provided with reset key pins 30 of a different length, so that a first reset key will turn a first warding member, a second reset key will turn both the first and a second warding member, and whereupon the first reset key may again be used to access another series of passkeys, and so on. By this it may be seen that an exponential increase in the number of possible passkeys accompanies the addition of each additional warding member. It is also possible to provide a single reset key 28 to serve the functions of the more than one reset keys described. This may be accomplished in any of a multitude of ways easily envisioned, such as by providing a mechanism to move the reset key pins 30 in concert, longitudinally in relation to a reset key body 82 seen in FIG. 1, or by providing a spacer to control the depth to which the reset key pins 30 can engage the warding members 60. An element protruding from a distal end 84 of the reset key 30 may serve the same purpose, and it may be made incrementally adjustable to provide for multiple warding members 60. Said element may also be constructed to register with one or more of said warding members 60 for indexing purposes, and for use with a reset key combination as later described.

A further refinement of the invention is accomplished by decreasing the number of reset pins 66 and reset pin bores 62 relative to the number of reset pin recesses 64. If the number is decreased by one, and likewise the number of reset key pins 30 is decreased in concert therewith, this construction provides a mechanism whereby, upon inserting and rotating the reset key 28 to select the next passkey, one reset pin recess 64 moves to an unused position, and one reset pin recess moves from an unused position to a used position, whereupon under the urging of a reset pin spring 68 the associated reset pin 66 is moved in a positive manner thereinto. This provides a detent function, and allows for positive indexing of the passkey changes, such that the warding member "snaps" into position. If the number of reset pins 66 is half of the number of reset pin recesses 64, the full compliment of passkey positions are usable, but the requirement for reset pins 66 is reduced, thereby reducing the complexity and therefore the cost of the lock, and the reset key 28, while increasing the strength of the cylinder plug 38. It is readily seen that any combination of numbers of reset pins and reset pin recesses may be used, not limited to those in which recesses outnumber pins, and may be optimized to the application of use of the lock. Likewise, an asymmetrical arrangement of reset pins and/or reset pin recesses may be employed.

The warding member 60 may be made of a sufficient thickness to allow the use of a surface pin 86 contained within the reset pin recess 64, the operation of which is similar to that described for the tumbler pin 54, in which case the reset pin 66 serves a function similar to that of the driver pin 44 previously described, and a reset pin stack is created. The surface pins 86 may be prevented from projecting past the front surface 72 of the warding member 60 by various common methods such as a chamfer, step, etc. In this embodiment, the reset key pins 30 may differ in length, to correspond to the lengths of the surface pins 86, and combinations having surface pins 86 in some bores and only reset pins 66 in others may be utilized. Also more than one surface pin 86 may be used in one or more of the reset pin bores 62. The advantage is of course, that multiple combinations of reset keys are possible, whereby use of a reset key for a series of locks for which it is not intended is preventable. Surface pins may be provided in all reset pin recesses 64, and a biasing means may be used to cause all surface pins to remain flush with the front of the warding member 60. Such a biasing means may be a coil spring or a wavy or bellevue washer, or a convex tabbed washer, and many other methods are available. This provides an improved appearance and pick resistance.

The reset pin stacks may be made of such a length relative to the reset pin bores 62, that it is impossible to push them in far enough that the entire stack will clear the warding member or members. One such stack per lock might provide sufficient security, or multiple such stacks may be employed.

Passkeys or master keys may also be made which will operate the lock when the warding member or members are in more than one passkey position, and such master keys need not operate the lock in the same passkey positions as other master keys.

The lock may also be provided with various anti-tamper devices, such as a spring loaded pin or ball which, if the reset pin 66 were released, such as by removal of the forwardmost end of the lock, would move into a position intersecting the shear plane between the lock cylinder 34 and the cylinder plug 38, thereby locking up the entire assembly.

Also, various features of the lock either provide or enable additional security. For instance, the nosepiece 58 may be constructed of a hardened material, and it may be tapered to discourage its being attacked with pliers. It may also be attached to the cylinder plug 38 in such a way that it is free to rotate. If a determined attacker is successful in removing the nosepiece 58 and the warding member 60, forcible entry has not been made any easier, because of the increased difficulty of keeping the picking tool on the tumblers due to the extra width of the keyway. The plug still cannot be rotated without a key, and if a key is inserted and used to attempt to rotate the plug, the camming forces of the tumbler pins against the angled recesses of the key will tend to lock up the assembly, the warding member no longer being available to transmit torque to the plug. This also will have the tendency to capture the key in the plug, thereby immobilizing the lock assembly and rendering it inoperable. Anti-pick cavities may be located in the cylinder plug in locations where rotation of the plug without the key in the lock would cause one or more driver pin to cross the shear plane and project into said cavity, immobilizing the lock. "Wiggling" of a key having the wrong key combination in an effort to operate the lock is prevented, due to the large contact area afforded by the shape of the key and keyway, and the non-standard key shape enhances key control because it cannot be readily duplicated. Since the retrofittable plug carries with it these advantages, installation in an existing "host" lock upgrades the security of the host, and existing security enhancements can be applied to it as well. Special anti-tamper mechanisms may be employed, or the lock can be set up to make use of a "closing key" with which an employee can lock the store, but cannot sequently unlock it. One such anti-tamper mechanism is a relock as shown in FIG.4 A relock pin bore 92 has fitted therein a relock pin 94, both being positioned radially in relation to the keyway 52 and on a rotational centerline with at least one plug and cylinder pin chamber 50, 40. The anterior end of the relock pin operatively engages one of the reset pins 66 so that if the reset pin 66 were to move outwards beyond the warding members 60, the relock pin 94 would be able to move inward. At this point, partial rotation of the cylinder plug 38 would allow one or more driver pin 44 to drop partially into the one or more reset pin bore 92, thereby preventing rotation of the cylinder plug 38. One or more relock might be positioned on either side of one or more plug pin chamber 50 as desired.

Having therefore provided a full, clear, and concise description of the invention, The Inventor Claims:

1. A lock, having at least one tumbler pin, wherein a first key, having an established configuration interoperable with said lock and enabling operation of said lock, and said first key having a key combination matching said lock, comprises:

a) integral with said lock, a warding member comprising:
- I) at least one movable member having a configuration interoperable with the configuration of said first key to allow use of said first key to operate said lock;
- II) an indexing means interoperable with said movable member to enable multiple positioning thereof;
- III) said indexing means comprises at least one reset pin operating independently of said at least one tumbler pin;
- IV) said first key having a limited range of orientations wherein use with said lock is possible, whereby;

b) said warding member is indexable to exclude the use of said first key to operate said lock, and;

c) said lock is operable without interaction between said first key and said indexing means.

2. The device in claim 1 wherein:

a) said lock has, associated therewith at least one alternate key,and;

b) indexing of said warding member allows the use of said at least one alternate key.

3. The device in claim 2 wherein:

a) said alternate key has a key combination identical to that of said first key.

4. The device in claim 1 wherein:

a) a reset key is used to index said indexing means;

b) said reset key cannot be used to operate said lock.

5. The device in claim 1 wherein exclusion of said first key creates an impediment to mating of said first key to said lock.

6. The device in claim 2 wherein more than one warding member is employed, allowing an exponential increase in the number of possible alternate keys.

7. The device in claim 2 wherein:

a) more than one alternate key can operate said lock at the same indexed position; and, b) indexing of said warding member will exclude at least one of the said more than one alternate keys.

8. The device in claim 2 wherein use of a master key is enabled.

9. The device in claim 1 wherein said lock with indexing means is retrofittable to an existing host lock assembly.

10. The device in claim 9 wherein said retrofit may be accomplished without any modification of the host lock assembly.

11. The device in claim 10 in which said lock with indexing means is a cylinder lock.

12. The device in claim 11 in wherein said lock with indexing means is retrofittable to all major brands of cylinder locks.

13. The device in claim 1 wherein said indexing means provides a detent function when indexing said warding member.

14. The device in claim 1 wherein a reset key having one key combination matching that of said lock, out of more than one possible key combinations, is required to index said warding member.

15. The device in claim 14 wherein at least one warding member housing at least one surface pin requires the use of a reset key having a key combination matching that created by said surface pin.

16. A cylinder lock comprising a lock cylinder, and a cylinder plug, having at least one tumbler pin disposed in conjunction therewith whereby at least a first key, having an established configuration interoperable with said lock, and a key combination matching said lock enables relative rotation between said lock cylinder and said cylinder plug wherein:

a) integral with said lock, a warding member comprises:

I) at least one movable member having a configuration interoperable with the configuration of said first key to allow use of said first key to operate said lock;

II) an indexing means interoperable with said movable member to enable multiple positioning thereof;

III) said indexing means comprises at least one reset pin operating independently of said at least one tumbler pin;

IV) said first key having a plurality of orientations wherein use with said lock is possible, whereby, b) said warding member is indexable to exclude the use of said first key to operate said lock.

17. The device in claim 16 wherein said indexing means is comprised of at least one reset pin coacting with at least one reset pin recess.

18. The device in claim 17 wherein said warding member houses at least one surface pin, whereby a reset key having a reset key combination matching that of said lock is required to index said warding member.

19. The device in claim 17 wherein said reset pin recesses outnumber said reset pins by at least one.

20. The device in claim 16 wherein:

a) At least one relock means is provided, for the purpose of increasing the tamper protection of said lock.

21. A lock cylinder plug, retrofittable to existing cylinder locks to create a cylinder lock assembly, wherein:

a) said plug comprises:

I) a warding member;

II) said warding member is rotatably indexable from a first position to at least a second position;

b) a reset key is used to index said warding member;

c) a first passkey will operate said cylinder lock when indexed to said first position;

d) at least one additional passkey will operate said cylinder lock when indexed to at least a second position.

22. A method of changing the key combination of a lock having at least one tumbler pin comprising the steps of:

a) Providing a cylinder lock having a first passkey configured so as to operate said lock, at least one lockable rotatably indexable warding member, a reset key configured to enable rotation of said indexable warding member, co-acting therewith at least one reset pin operating independently of said at least one tumbler pin, and a second passkey, said reset key and said passkeys functioning independently of each other, b) Using said reset key to change the combination of said lock by rotating said warding member;

c) Providing said second passkey with a warding cut positioned so as to co-act with said lock and said warding member so as to enable operation of said lock with said warding member in said second position whereas;

d) Said first passkey is not able to operate said lock.

23. The method of claim 22 wherein: a) At least one master key is provided which is configured to operate said lock in more than one position of said at least one warding member.

24. The method of claim 22 further comprising the steps of:

a) Providing said lock with at least one relock means.

* * * * *